United States Patent [19]

Katayama et al.

[11] 3,976,473

[45] Aug. 24, 1976

[54] METHOD FOR PRODUCING AN EXTREMELY LOW CARBON AND NITROGEN STEEL IN A VACUUM REFINING APPARATUS

[75] Inventors: Hiroyuki Katayama; Makoto Inatomi, both of Kitakyushu, Japan

[73] Assignee: Nippon Steel Corporation, Tokyo, Japan

[22] Filed: Dec. 27, 1974

[21] Appl. No.: 536,983

[30] Foreign Application Priority Data

Dec. 31, 1973 Japan ..... 49-3860

[52] U.S. Cl. ..... 75/49; 75/59; 75/60; 266/207

[51] Int. Cl.[2] ..... C21C 7/10; C21C 5/32; C21C 5/42

[58] Field of Search ..... 75/49, 60, 59; 266/34 V

[56] References Cited

UNITED STATES PATENTS

| | | | |
|---|---|---|---|
| 2,954,244 | 9/1960 | Austin | 75/60 |
| 3,773,496 | 11/1973 | Knuppel | 75/49 |

*Primary Examiner*—Peter D. Rosenberg
*Attorney, Agent, or Firm*—Toren, McGeady & Stanger

[57] ABSTRACT

A method for producing an extremely low carbon and nitrogen steel in a vacuum refining apparatus by effectively preventing air-leaks from the furnace tank, so as to lowering the nitrogen partial pressure within the tank.

3 Claims, 5 Drawing Figures

FIG.5 (Cr=18%)
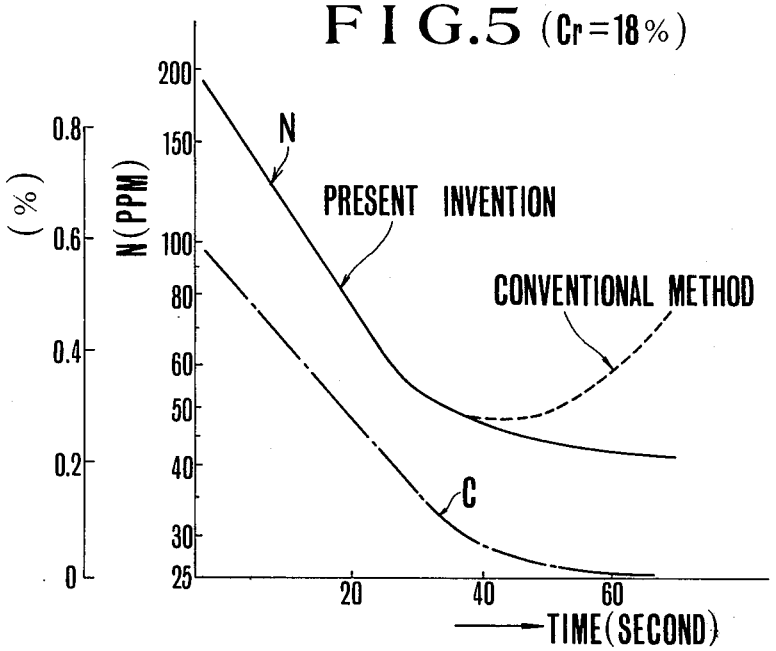

METHOD FOR PRODUCING AN EXTREMELY LOW CARBON AND NITROGEN STEEL IN A VACUUM REFINING APPARATUS

The present invention relates to a method for producing an extremely low carbon and nitrogen steel in a so-called vacuum refining apparatus, in which a tank enclosing a container containing molten steel under air-tight conditions is evacuated and the molten steel is refined with oxygen blowing thereinto.

In general, removal of nitrogen from the molten steel can be effected only at a low rate, and it is difficult to lower the nitrogen content in the molten steel merely by a vacuum treatment.

However, when oxygen is blown into or on the molten steel under a reduced pressure to effect decarburization, the rate of nitrogen removal is increased by boiling of the molten steel due to CO gas generation and the partial pressure of nitrogen in the atmosphere lowers to reduce the equilibrium amount of nitrogen in the molten steel so that the nitrogen removal is more easily effected.

Therefore, in order to produce a higher quality low nitrogen steel, it is important to maintain the nitrogen partial pressure in the atmosphere as low as possible, but the following difficulties have been confronted with in commercial vacuum melting of an extremely low carbon steel.

1. It is difficult to completely prevent air-leaks.
2. In the extremely low carbon stage, the decarburization rate is smaller so that it is necessary to lower the oxygen blowing rate, and thus, as compared with the stage where a large decarburization rate is attained, the nitrogen partial pressure increases.
3. Although, it may be considered to increase the vacuum degree for the purpose of lowering the nitrogen partial pressure in the extremely low carbon zone, there is a limitation in increasing the vacuum degree due to the vacuum pump capacity, and when the vacuum degree is increased, there is the danger of increased molten metal splash due to the CO bubbles from the molten steel.

These difficulties indicate that it is difficult to maintain the nitrogen partial pressure at less than a certain value within the tank in the finishing stage of the refining. Therefore, in actual operations, the nitrogen content, which lowers once during the initial and middle stages of the refining tends to increase again during the finishing stage of the oxygen blowing.

The conventional processes have been directed to attain a predetermined vacuum degree from the aspect of the decarburization reaction rather than to preventing the air-leaks. Therefore, the conventional processes are limited with respect to obtaining an extremely low carbon and nitrogen steel which is the aim of the present invention.

Therefore, one of the objects of the present invention is to provide a method for producing an extremely low carbon and nitrogen steel in a vacuum refining apparatus by effectively preventing air-leakage of the furnace tank, so as to lowering the nitrogen partial pressure within the tank.

The features of the present invention lies in a method of producing an extremely low carbon and nitrogen steel in a vacuum refining apparatus, in which a container containing molten steel or a tank enclosing the container is closed air-tight with a lid having a lance hole, and comprises sealing a contact surface between the container or the tank and the lid and a contact surface between the lance and the lid with a double seal, reducing the pressure within the container or the tank, blowing oxygen from the lance into the molten steel to refine it, supplying an inert gas, such as, argon gas to the space within the double seal at a pressure higher than the atmospheric pressure during the finishing stage of the refining, when the decarburization rate lowers, and successively conducting the oxygen blowing under a reduced pressure.

The present invention will be described in more detail referring to the attached drawings.

Figure 1:
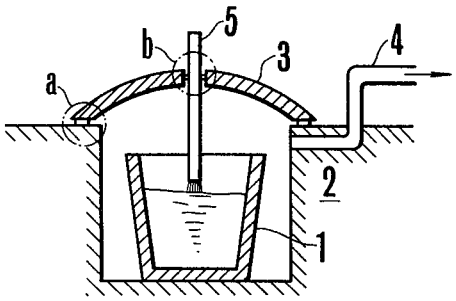
FIG. 1 shows a schematic view of a closed type of vacuum furnace.
Figure 3:
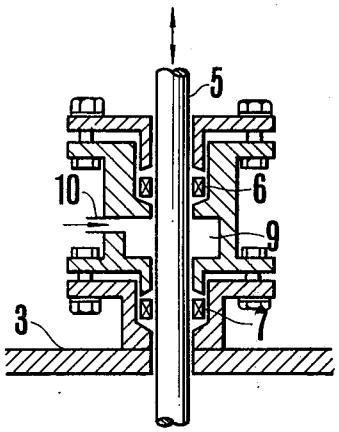

FIG. 3 similarly shows the sealing mechanism according to the present invention at the portion *b* in FIG. 1.

Figure 4:
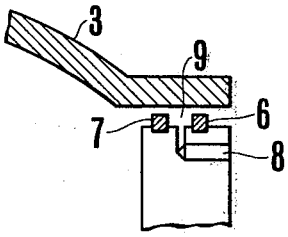

FIG. 4 shows a conventional sealing mechanism.

FIG. 5 is a graph showing changes in the nitrogen and carbon contents in the molten steel obtained by the present invention in comparison with a conventional method.

In FIG. 1, 1 is a molten steel ladle, 2 is a pit, 3 is a air tight lid covering the pit, 4 is an exhaust pipe through which the inside of the pit 2 is evacuated. An oxygen lance 5 is inserted through a lance hole 6 provided through the lid 2.

According to the conventional method for sealing the apparatus, the sealing is effected at the contact surface between the lid and pit and at the contact surface between the oxygen lance and the lid using an O-ring as shown in FIG. 1. The sealing effect in this case depends on the flatness of the contact surfaces, the condition of the O-ring and the fastening degree, and thus a high sealing effect is hard to maintain.

Figure 2:
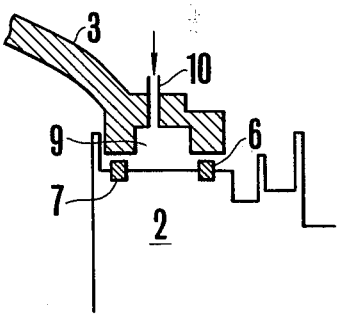
FIG. 2 shows the sealing mechanism according to the present invention at the portion *a* in FIG. 1.

According to the present invention, a double sealing mechanism is provided both on the contact surface between the lid 3 and the pit 2 as shown in FIG. 2 and the contact surface between the oxygen lance 5 and the lid 3 as shown in FIG. 3. An outer gasket 6 and an inner gasket 7 are set with a certain space so to introduce the inert gas to an air-tight chamber 9 through a gas supply path.

In case of a small vacuum melting furnace, a structure with a double sealing mechanism as shown in FIG. 4 has been known, but in this case, the exhaust pipe 8 is extended so as to suck the air coming into the air-tight chamber 9 from outside. Therefore, the structure shown in FIG. 4 requires complicated pipings and operations of the vacuum system.

According to the present invention, the space in the air-tight chamber is pressurized by supplying the inert gas, such as, argon gas rather than exhausting or depressurizing so that the air is prevented from coming into the space from outside, and thus introduction of nitrogen into the apparatus is completely prevented.

For example, argon gas is introduced into the air-tight chamber 9 and adjustment is made, so as to maintain an almost constant pressure in a range from 1.0 to 5.0 kg/cm$^2$ therein. In this way, the air-leak from the interstice between the outer gasket 6 and the lid 3 or the oxygen lance 5 can be prevented, and the partial pressure of nitrogen within the apparatus is lowered as the inert gas is allowed to leak into the apparatus from the space provided by the inner gasket 7.

Thus, the partial pressure of nitrogen can be maintained reasonably at a low level according to the present invention.

The inert gas pressure within the air-tight chamber 9 can be adjusted within the above range corresponding to the required level of nitrogen content in the molten steel. If the gas pressure is lower than 1.0 kg/cm$^2$ (guage pressure), an air-leak into the air-tight chamber 9 is caused, and on the other hand, if the gas pressure is above 5.0 kg/cm$^2$ the gas liberation into the air is increased, thus lowering the gas efficiency.

The supply of the inert gas to the air-tight chamber need not be continuous through the whole refining operation, and it is enough to supply the gas only for the period during which the nitrogen content in the molten steel increases again in the finishing stage (extremely low carbon stage) of the refining.

In this way, it is possible to prevent the air-leak by a simple operation and to maintain the nitrogen partial pressure within the apparatus at a far lower level as compared with the conventional art, and thus an extremely low carbon and nitrogen steel can be produced easily according to the present invention.

FIG. 5 is a graph showing changes of the nitrogen content in the molten steel, as compared between the case where the argon gas is supplied at a pressure of 2 kg/cm$^2$ and the case when no argon gas is supplied. As clearly understood from the graph, the nitrogen content increases sharply in the finishing stage of the refining when no argon gas is supplied, but if argon gas is supplied at this stage, the nitrogen content after the treatment is maintained at a very low level as shown by the solid line.

The following table shows the results of the present invention and the conventional method.

| | Sealing Condition | Composition (%) after oxygen blowing C | Cr | N |
|---|---|---|---|---|
| Conventional | — | 0.01 | 18 | 0.0090 |
| Present Invention | Argon gas pressure of 2 kg/cm$^2$ within the air-tight chamber | 0.01 | 18 | 0.0050 |

What is claimed is:

1. In a method for producing low carbon and nitrogen steel using a vacuum refining apparatus wherein molten steel is placed in a container and a lid is placed on the container, the lid having contact surfaces which are in air-tight sealed relationship with contact surfaces on the container, the lid also having an oxygen lance projecting therethrough, the contact surfaces of the lance being in air-tight sealed relationship with contact surfaces of said lid and wherein the pressure within the thus sealed container is reduced and oxygen is blown into the steel from the lance to refine the steel, the improvement wherein the respective sealed relationships between the contact surfaces of the container and the lid and the lance and the lid are each provided by double seals, said double seals defining a chamber between each seal making up said individual double seals, said chambers having an entrance port, and wherein during the refining operation, an inert gas is introduced to said chambers, the pressure of the inert gas in the chambers being greater than that in the sealed container whereby leakage of air into the chamber is minimized and a portion of the inert gas leaks into the container thereby decreasing the partial pressure of nitrogen gas within said container.

2. The method of claim 1 wherein the container is in a pit and the lid is in air tight sealed relationship with the sides of the pit.

3. The method of claim 1 wherein the inert gas is argon.

* * * * *